US005621267A

United States Patent [19]

Shaffner et al.

[11] Patent Number: 5,621,267

[45] Date of Patent: Apr. 15, 1997

[54] HIGH-POWER METAL HALIDE REFLECTOR LAMP

[75] Inventors: Richard O. Shaffner, San Jose; John F. Richter, Redwood City, both of Calif.

[73] Assignee: ILC Technology, Inc., Sunnyvale, Calif.

[21] Appl. No.: 408,637

[22] Filed: Mar. 22, 1995

[51] Int. Cl.[6] ..... H01J 5/16

[52] U.S. Cl. ..... 313/113; 313/11; 313/35; 313/36; 445/58

[58] Field of Search ..... 313/113, 112, 313/11, 22, 35, 36; 359/360; 445/58, 22, 23; 362/341, 345, 348

[56] References Cited

U.S. PATENT DOCUMENTS

| | | | |
|---|---|---|---|
| 3,936,686 | 2/1976 | Moore | 313/113 |
| 3,944,320 | 3/1976 | McLintic | 359/360 |
| 4,686,419 | 8/1987 | Block et al. | 313/641 |
| 5,144,190 | 9/1992 | Thomas et al. | 313/113 |
| 5,177,396 | 1/1993 | Gielen | 313/113 |

FOREIGN PATENT DOCUMENTS

| | | |
|---|---|---|
| 0470496 | 2/1992 | European Pat. Off. . |

*Primary Examiner*—Nimeshkumar Patel
*Attorney, Agent, or Firm*—Thomas E. Schatzel; Law Offices of Thomas E. Schatzel A Prof. Corporation

[57] ABSTRACT

A metal halide lamp includes a cast ceramic reflector almost completely comprised of alumina. A conventional metal halide bulb is positioned within the reflector. A glaze and then a dielectric coating are applied to the inside surface of the reflector, such that appreciable amounts of infrared radiation from the bulb are absorbed into the glaze and ceramic and not reflected into the beam.

8 Claims, 2 Drawing Sheets

HIGH-POWER METAL HALIDE REFLECTOR LAMP

BACKGROUND OF THE INVENTION

1. Field of the Invention

The invention relates generally to metal halide lamps and specifically to the construction of such lamps with alumina ceramic reflectors.

2. Description of the Prior Art

Werner Block, et al., describe a metal halide high-pressure discharge lamp in U.S. Pat. No. 4,686,419, issued Aug. 11, 1987. A glass bulb in the general shape of a cylindrical tube with electrodes protruding at the two ends is filled with a noble gas, like argon, and a small amount of mercury. A halogen component of the metal halide comprises iodine and/or bromine. An average light density in excess of thirty kilostilb with a specific arc power of 400 to 5,000 watts per centimeter is obtained over an average lifetime of 250 hours is reported. Such lamps find application in optical projection systems when used in combination with a reflector. FIG. 3 of Block, et al., is repeated herein as FIG. 1.

FIG. 1 illustrates a cross-sectional view of a lamp 10 with a reflector 13 "securely connected and assembled" with a bulb 14. The bulb 14 has a power rating of 270 watts, and is coaxial with the axis of the reflector 13. An electrode shaft 15 is secured by a "suitable cement 16" to a ceramic base 17. Another electrode shaft 18 is attached to the edge of the reflector 13 by a pair of copper strips 19 and **19*a*, fitted into a ceramic terminal ring 20. An electrical connection to the copper strips 19 and 19*a* provide one terminal for a power supply. The copper strips 19 and 19*a* further serve as cooling fins. A pair of electrodes 21 and 22 are connected to a pair of molybdenum foils 23 and 24 that are melt-sealed into the lamp shafts 15 and 18. The foils 23 and 24 are connected to a pair of electrical terminals 25 and 26. An electrical connection 27 is connected to the foil 23 and to the base 17. Another connection 28 is fitted into the ring 20 and electrically connected to the copper strips 19 and 19*a*. Thus, the terminals 27 and 28 provide for connection to a power supply. The reflector 13** is described as being a "mirrored ceramic or glass".

Commercial products that generally fit the description of FIG. 1 have wire leads with high-voltage insulation and an industry-standard connector. Typical uses include small spot lights used at rock concerts. Such conventional lamps typically have short lives and suffer from cracking of their reflectors. Many different commercial producers have tried a variety of materials and configurations in the construction of their respective reflectors, albeit none with much success. Osram (Germany) markets a "HTI" lamp which has a glass (borosilicate)reflector with a dielectric reflective coating that allows infrared radiation from the bulb to pass through the glass. Such reflectors have been observed to prematurely crack under the heat generated by its metal halide bulb. Ushio (Japan) markets a lamp with glass ceramic reflector and a dielectric reflective coating that is very robust, but costs more than a ceramic reflector. Reflectors that pass-through the infrared radiation and that do not absorb it are responsible for the uncontrolled heating of boxes and fixtures that house such lamps. Such housings exacerbate such heating by being typically painted black.

SUMMARY OF THE PRESENT INVENTION

It is therefore an object of the present invention to provide a metal halide high-pressure discharge lamp with a heat resistant reflector that allows for increased bulb power.

It is a further object of the present invention to provide a metal halide high-pressure discharge lamp capable of operating at powers as high as 600 watts.

Briefly, a metal halide lamp embodiment of the present invention is an improved projection lamp with a cast ceramic reflector almost completely comprised of alumina. A conventional metal halide bulb is positioned within the reflector. A glaze and then a dielectric coating are applied to the inside surface of the reflector, such that appreciable amounts of infrared radiation from the bulb are absorbed into the glaze and ceramic and not reflected into the beam.

An advantage of the present invention is that a metal halide high-pressure discharge lamp is provided that operates at higher-than-conventional power levels without cracking of the reflector.

Another advantage of the present invention is that a metal halide high-pressure discharge lamp is provided with a substantial portion of the infrared radiation being dispersed rather than being reflected and focused into the beam.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENTS

Figure 2:
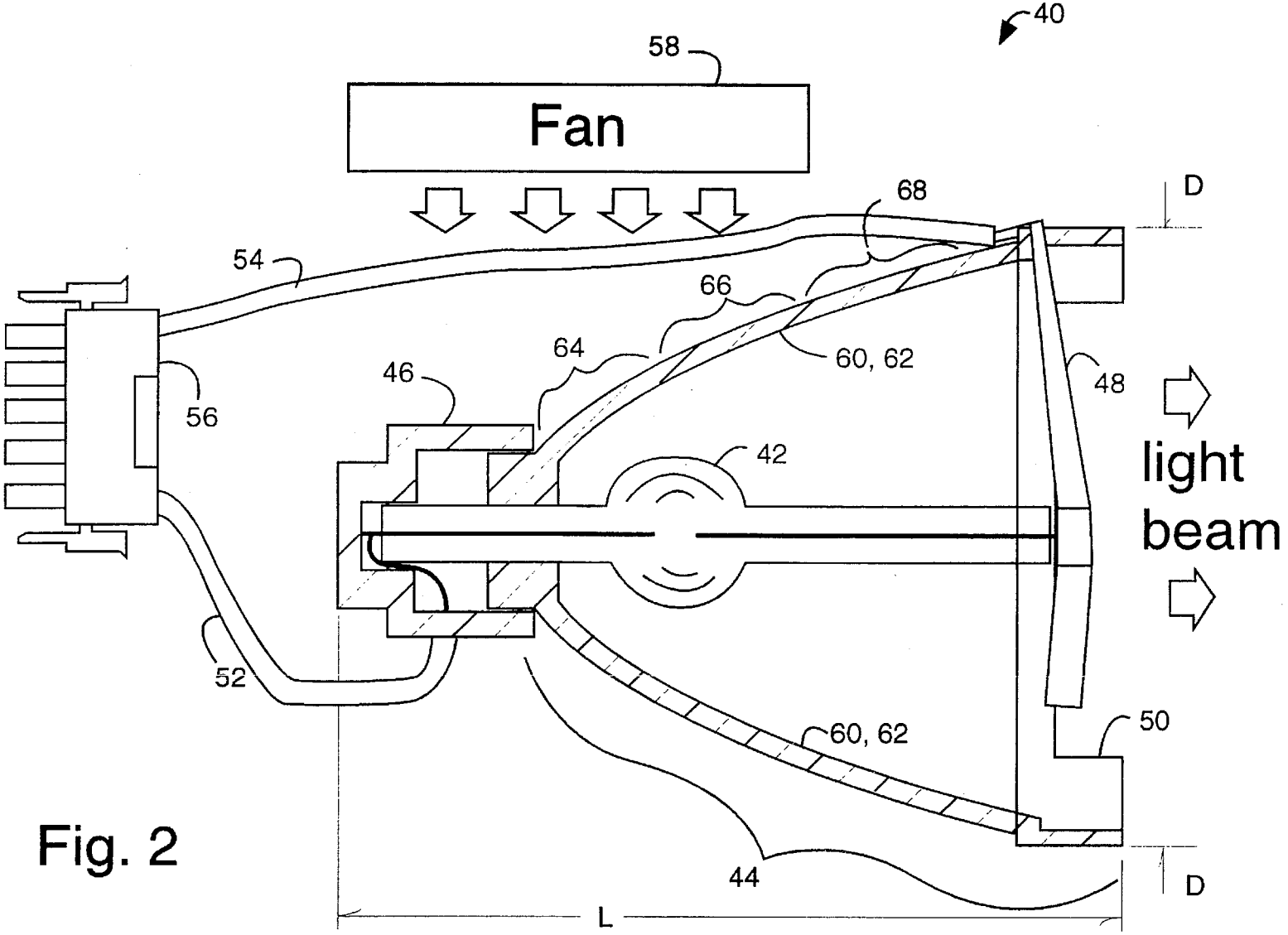
FIG. 2 is a cross-sectional view of a metal halide high-pressure discharge reflector lamp embodiment of the present invention.

FIG. 2 illustrates an embodiment of a metal halide high-pressure discharge lamp system of the present invention, referred to herein by the general reference numeral 40. Lamp system 40 comprises a 400 watt metal halide arc lamp bulb 42 rated for 500 hour life and coaxially positioned within a ceramic reflector body 44. The bulb 42 is filled with an inert gas through which an electric arc is sustained and thus operates with high internal gas pressures. A 150 watt tubular sapphire xenon short arc lamp may be substituted for the bulb 42 in an alternative embodiment. A ceramic cap 46 is cemented to the end of the reflector body 44 with one end of the bulb 42. The bulb 42 is preferably operated during assembly before cementing to the reflector body 44 so that the resulting optical light beam pattern can be fine tuned. A cooling fin 48, made of metal, such as copper, makes an electrical connection to another end of the bulb 42 and acts as a strut from an edge of the reflector body 44 to give some mechanical support to the otherwise free end of the bulb 42. A front locating notch 50 suits an industry-standard mounting ring for such lamps. The reflector body 44 has an outside maximum diameter "D" of approximately two and one-half inches and has an overall length "L" when cemented to the cap 46 of two and three-quarter inches. Larger dimensions are possible, and seem to be limited only by how large an alumina cast outside commercial vendors can provide. In the Santa Clara County area of California, three inch castings were readily available. A pair of wires 52 and 54 with insulation rated for 25 KVDC and operating temperatures as high as 150° C. connect the bulb 42 to an industry-standard pin-and-socket connector 56. A fan 58 blows cooling air over the reflector body 44 which becomes heated during operation of the lamp system 40 by infrared radiation absorbed from the bulb 42. The fan 58 controls heating of surrounding equipment by pumping hot air away that has first been circulated around the reflector body 44.

The lamp system 40 is an improvement over the prior art in that the material of the reflector body 44 is a single cast piece of alumina, essentially 100% $Al_2O_3$. The inside surface of the reflector body 44 further has a glaze 60 with a dielectric coating 62. The glaze 60 provides a smooth reflective ("glassy") surface on the otherwise rough inside surface of the reflector body 44, and makes it suitable for specular reflection.

The glaze 60 comprises GL-40 frit glaze, aluminum oxide, gum Arabic, detergent and distilled water rolled in a mill jar for twenty-four hours. An initial viscosity of 150±50 centipoise is preferred, which is diluted to 100±20 centipoise for spraying. The inside of the reflector body 44 is sprayed with the glaze, such that the resulting fired glaze weight is 0.85 to 2.20 grams. The glazed reflector body 44 is fired in a furnace starting at a temperature of approximately 200° C., rising to approximately 710° C., and then allowing the body to cool slowly.

The dielectric coating 62 forms a dichroic cold-mirror to selectively reflect visible light, with wavelengths in the range of 400–725 nanometers, and pass through infrared light. In an alternative embodiment intended for ultraviolet lamp applications, e.g., "black lights", it is desirable to reflect only light in the ultraviolet range. In order not to short-circuit the electric voltage across the bulb 42, the dielectric coating 62 is comprised of an electrically non-conductive material. Standard coatings from Bausch and Lomb, marketed as their "hard coating" may be used, which typically comprise forty alternating layers of silica $SiO_2$ and one or more of titania, tantala or hafnia. Coatings for use at operating temperatures of 500° C.–700° C. have given good results. Coatings for use at lower temperatures are acceptable, but have not been tested.

The glaze 60 and reflector body 44 absorb most of the infrared radiation of the bulb 42 that is passed through by the dielectric coating 62. This permits the heat to be controlled and removed by the fan 58.

The inside reflective surface of the reflector body 44 is alternatively shaped in a set of three blended elliptical, concentric sections 64, 66 and 68. This preferably results in a light beam pattern of three distinct rings in the far field that are formed within an aperture dimension. In some applications, it is advantageous to allow the glaze 60 to run with over-spraying, such that a slightly rippled surface is obtained. This rippling tends to soften the light beam pattern by diffusing the reflections of the coating 62.

Figure 3:
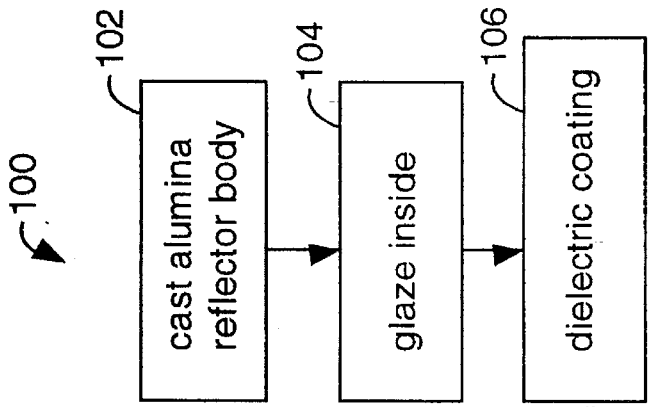
FIG. 3 is a flow chart for a method of manufacturing the reflector body of the lamp of FIG. 2.
Figure 1:
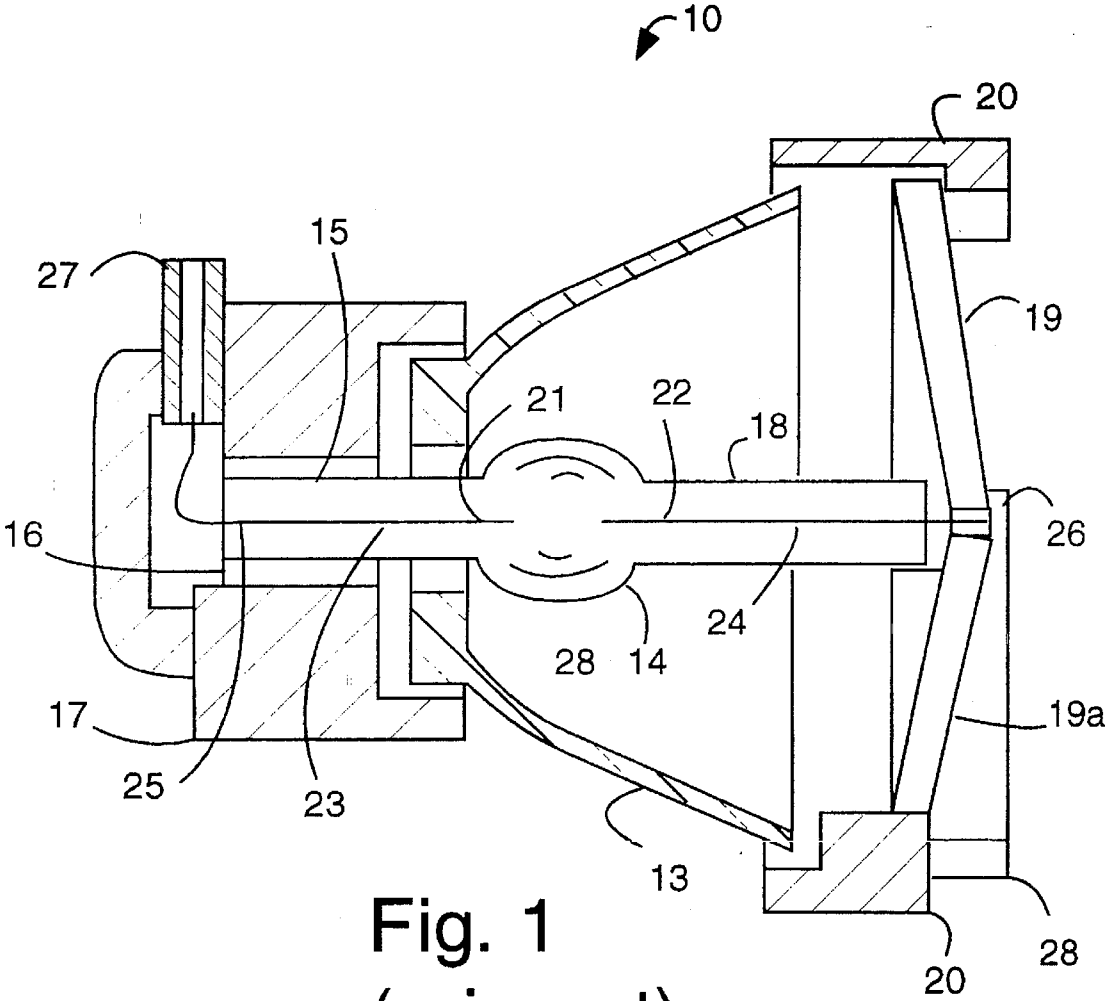
Fig. 1 (prior art)
FIG. 1 is a cross-sectional view of a prior art reflector lamp.

FIG. 3 illustrates a method 100 of manufacturing a reflector for the lamp system 40 of FIG. 2. A casting is made in a step 102 of the reflector body 44 of essentially 100% alumina. A step 104 glazes the inside reflector surface of the reflector body 44 to provide a glassy surface for good reflective qualities and a proper base for the coatings, e.g., coating 62. Where a slightly rippled surface is desired to diffuse the reflected light, the step 104 includes over-spraying the glaze such that it runs or sags slightly. A step 106 applies a conventional dielectric coating on the glassy surface of the glaze. The choice of what type of dielectric coating is applied, depends on what application the lamp will be put to. The alternative coatings provide for the reflection of ultraviolet light with the absorption of visible and infrared light by the glaze and the reflector body, or they provide for the reflection of visible light and the absorption of infrared light by the glaze and the reflector body. Which range of light is to be reflected is determined by the application of a user.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An improved metal halide high-pressure discharge lamp system with an inert-gas-filled arc bulb positioned within a reflector to focus outward a beam of light during operation, said reflector comprising:

a single cast piece of 100% ceramic alumina $Al_2O_3$ that forms a substrate of said reflector;

a glaze on an inside concave surface of said substrate ad with a glassy surface providing for specular reflection of light from said arc bulb; and an electrically non-conductive dielectric coating on an inside concave surface of the glaze for reflecting non-infrared radiation from said bulb into said beam of light and for passing infrared radiation from said arc bulb into the glaze and the cast ceramic alumina substrate for absorption;

wherein, the glaze and cast ceramic alumina substrate absorb most of the infrared radiation that is passed through by the dielectric coating from said arc bulb and is converted to heat that may be controlled and removed by a forced air flow.

2. The improved lamp system of claim 1, further comprising:

forced air means directed at the cast ceramic alumina material of said reflector for cooling, wherein air heated by said cooling is routed away, wherein a fan is used to control heating of a surrounding structure by pumping hot air away that has first been circulated around said reflector.

3. The improved lamp system of claim 1, wherein:

said inert-gas-filled arc bulb comprises one of a high-pressure metal halide lamp or a tubular sapphire xenon short arc lamp; and the glaze includes runs from over-spraying such that a slightly rippled surface is obtained and provides for a softening of said beam of light by diffusion.

4. The improved lamp system of claim 1, wherein:

said cast ceramic material is shaped in a set of three blended elliptical, concentric sections providing during lamp operation for a far-field light beam pattern of three distinct rings.

5. A method of manufacturing a reflector for a metal halide high-pressure discharge lamp, the method comprising the steps of:

casting substantially 100% alumina in the shape of a lamp reflector;

glazing an inside surface of said lamp reflector to obtain a glassy surface of glaze suitable for specular reflection; and coating said glass surface of said glaze with a dielectric coating such that visible light is reflected by said coating and infrared radiation is absorbed by said glaze and said lamp reflector.

6. An improved metal halide high-pressure discharge lamp system with a metal halide bulb positioned within a reflector to focus outward a beam of ultraviolet light during operation, said reflector comprising:

a single cast piece of 100% ceramic alumina $Al_2O_3$ that forms a substrate of said reflector;

a glaze on an inside concave surface of said substrate and with a glassy surface providing for specular reflection of light from said arc bulb; and an electrically non-conductive dielectric coating on an inside concave surface of the glaze for reflecting ultraviolet radiation from said bulb into said beam of light and for passing visible and infrared radiation from said bulb into the glaze and the cast ceramic alumina substrate for absorption.

7. The improved lamp system of claim 6, further comprising:

forced air means directed at the cast ceramic alumina material of said reflector for cooling, wherein a fan is used to control heating of a surrounding structure by pumping hot air away that has first been circulated around said reflector.

8. A method of manufacturing a reflector for a metal halide high-pressure discharge lamp, the method comprising the steps of:

casting substantially 100% alumina in the shape of a lamp reflector;

glazing an inside surface of said lamp reflector to obtain a glassy surface of glaze suitable for specular reflection; and coating said glass surface of said glaze with a dielectric coating such that ultraviolet light is reflected by said coating and visible and infrared radiation are absorbed by said glaze and said lamp reflector.

* * * * *